US011173544B2

(12) United States Patent
Kawabata et al.

(10) Patent No.: US 11,173,544 B2
(45) Date of Patent: Nov. 16, 2021

(54) CASTING APPARATUS AND METHOD FOR PRODUCING CASTINGS USING IT

(71) Applicant: HITACHI METALS, LTD., Tokyo (JP)

(72) Inventors: Masahide Kawabata, Moka (JP); Toru Iwanaga, Moka (JP); Kiyoshi Suehara, Moka (JP); Yutaka Morita, Moka (JP); Masafumi Kokubo, Moka (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 17/184,954

(22) Filed: Feb. 25, 2021

(65) Prior Publication Data

US 2021/0178463 A1 Jun. 17, 2021

Related U.S. Application Data

(60) Division of application No. 15/903,187, filed on Feb. 23, 2018, now abandoned, which is a continuation of (Continued)

(30) Foreign Application Priority Data

Sep. 30, 2013 (JP) ..... 2013-203824

(51) Int. Cl.
*B22D 27/13* (2006.01)
*B22D 27/09* (2006.01)
(Continued)

(52) U.S. Cl.
CPC ..... *B22D 27/13* (2013.01); *B22C 9/08* (2013.01); *B22D 18/02* (2013.01); *B22D 18/04* (2013.01); *B22D 27/09* (2013.01); *B22D 41/58* (2013.01)

(58) Field of Classification Search
CPC ..... B22D 18/04; B22D 27/09; B22D 27/13
(Continued)

(56) References Cited

U.S. PATENT DOCUMENTS 5,302,337 A 4/1994 Krajewski
5,348,073 A 9/1994 Kubo et al.
(Continued)

FOREIGN PATENT DOCUMENTS

EP 1944105 A1 7/2008
EP 3012045 A1 4/2016
(Continued)

OTHER PUBLICATIONS

Notice of Reasons for Rejection issued by Korean Intellectual Property Office dated Jul. 16, 2020, in Application No. 10-216-7011536 (10 pages including translation).
(Continued)

*Primary Examiner* — Kevin E Yoon
(74) *Attorney, Agent, or Firm* — Sughrue Mion, PLLC

(57) ABSTRACT

A casting apparatus for producing a casting by pouring a metal melt into a gas-permeable casting mold by gravity, comprising: a gas-permeable casting mold comprising a cavity including a sprue composed of a tubular portion and a cup portion having a larger diameter than that of the tubular portion to receive the metal melt, a runner constituting a flow path of the metal melt supplied through the sprue, and a product-forming cavity to be filled with the metal melt sent through the runner; a means for pouring the metal melt into the sprue by gravity; a gas-blowing unit comprising a gas-ejecting member to be connected to the sprue; and a mechanism for moving the gas-ejecting member; the gas-ejecting-member-moving mechanism placing the gas-ejecting member at a position just above the tubular portion and not interfering with gravity pouring of the metal
(Continued)

melt, and moving it downward for connection to the tubular portion; the gas-blowing unit having blowing a gas to fill the product-forming cavity with the metal melt.

5 Claims, 16 Drawing Sheets

Related U.S. Application Data application No. 15/025,600, filed as application No. PCT/JP2014/076229 on Sep. 30, 2014, now Pat. No. 9,950,363.

(51) Int. Cl.

| | |
|---|---|
| ***B22D 18/04*** | (2006.01) |
| ***B22C 9/08*** | (2006.01) |
| ***B22D 18/02*** | (2006.01) |
| *B22D 41/58* | (2006.01) |

(58) Field of Classification Search
USPC ..... 164/119, 120
See application file for complete search history.

(56) References Cited

U.S. PATENT DOCUMENTS

| | | | |
|---|---|---|---|
| 5,954,113 | A | 9/1999 | Buchborn |
| 6,035,923 | A | 3/2000 | Oda et al. |
| 6,283,196 | B1 | 9/2001 | Jacobsen et al. |
| 8,062,578 | B2 | 11/2011 | Noda et al. |
| 2009/0151887 | A1 | 6/2009 | Goka |
| 2016/0136726 | A1 | 5/2016 | Watanabe et al. |
| 2016/0144425 | A1 | 5/2016 | Kawabata et al. |

FOREIGN PATENT DOCUMENTS

| | | | |
|---|---|---|---|
| EP | 3012046 | A1 | 4/2016 |
| JP | 57-32869 | A | 2/1982 |
| JP | 60-154867 | A | 8/1985 |
| JP | 63-41352 | U | 3/1988 |
| JP | 10-216922 | A | 8/1998 |
| JP | 10-249512 | A | 9/1998 |
| JP | 2000-42718 | A | 2/2000 |
| JP | 2007-75862 | A | 3/2007 |
| JP | 2010-269345 | A | 12/2010 |
| JP | 2015-000404 | A | 1/2015 |

OTHER PUBLICATIONS

Communication dated Jun. 16, 2017 from the European Patent Office in counterpart Application No. EP 14847220.2.
Communication dated Mar. 2, 2017, issued by the State Intellectual Property Office of the P.R.C. in corresponding Chinese Application No. 201480054048.9.
International Search Report for PCT/JP2014/076229 dated Nov. 4, 2014.
EPO Translation of JP2010-269345A (Year: 2010).
EPO Translation of JP10-216922A (Year: 1998).

CASTING APPARATUS AND METHOD FOR PRODUCING CASTINGS USING IT

CROSS REFERENCE TO RELATED APPLICATIONS

This application is a Divisional of U.S. application Ser. No. 15/903,187 filed Feb. 23, 2018, which is a continuation of U.S. application Ser. No. 15/025,600 filed Mar. 29, 2016, now U.S. Pat. No. 9,950,363 issued on Apr. 24, 2018, which is a National Stage of International Application No. PCT/JP2014/076229 filed Sep. 30, 2014 (claiming priority based on Japanese Patent Application No. 2013-203824 filed Sep. 30, 2013), the contents of which are incorporated herein by reference in their entirety.

FIELD OF THE INVENTION

The present invention relates to a casting apparatus for obtaining desired castings with a gas-permeable casting mold, and a method for producing a casting using it.

BACKGROUND OF THE INVENTION

To produce castings by gravity pouring (hereinafter also called "pouring"), a gas-permeable casting mold composed of sand particles (so-called sand mold) is most generally used. With such a gas-permeable casting mold, a gas (generally air) remaining in a cavity of a particular shape is pushed out of the cavity by a metal melt (hereinafter also called "melt"), and the melt is formed into a casting having substantially the same shape as the cavity. The cavity of the casting mold generally includes a sprue, a runner, a feeder and a product-forming cavity, into which a melt is supplied in this order. In the conventional technologies, when a melt head in the sprue becomes high enough to fill a product-forming cavity, the pouring of the melt is finished.

A solidified melt forms a casting integrally extending from the sprue to the runner, the feeder and the product-forming cavity. The feeder is not an unnecessary portion for obtaining sound castings, while the sprue and the runner are merely paths for a melt to reach the product-forming cavity, which need not be filled with the melt. Thus, as long as a melt filling the sprue and the runner is solidified, drastic improvement in a pouring yield cannot be expected. In the case of castings integrally having unnecessary portions, considerable numbers of steps are needed to separate cast products from unnecessary portions, resulting in low production efficiency. Accordingly, the sprue and the runner pose large problems in increasing efficiency in gravity casting.

Recently, a revolutionary method for solving the above problems has been proposed by JP 2007-75862 A and JP 2010-269345 A. To fill a desired cavity portion, part of a cavity in a gas-permeable casting mold, this method pours a metal melt into the cavity by gravity in a volume smaller than that of an entire casting mold cavity and substantially equal to that of the desired cavity portion; supplies a compressed gas to the cavity through a sprue before the melt fills the desired cavity portion; and then solidifies the melt filling the desired cavity portion. By this method, it is expected to make it substantially unnecessary to fill a sprue and a runner with a melt, because pressure to be obtained by the melt head height is given by the compressed gas.

OBJECT OF THE INVENTION

As a result of reviewing the method described in JP 2007-75862 A and JP 2010-269345 A, the inventors have found that necessary switching from a gravity-pouring step to a gas-blowing step is not well timed, resulting in stagnant melt supply to the product-forming cavity, and thus likely providing products with cold shut, pull down, and other defects. To avoid problems due to such stagnation of melt supply, a casting apparatus is required to conduct such switching as quickly as possible. However, any specific structures and operations therefor have not been proposed yet.

Accordingly, an object of the present invention is to provide a casting apparatus capable of quickly switching from a gravity-pouring step to a gas-blowing step, and a method for producing a casting using it.

DISCLOSURE OF THE INVENTION

As a result of intensive research in view of the above object, the inventors have found that the above problem can be solved by placing a gas-ejecting member at a position just above a tubular portion of a sprue at least at the end of pouring of the melt, and simply moving it downward after the pouring of the melt ends, thereby connecting the gas-ejecting member to the sprue. The present invention has been completed based on such finding.

Thus, the casting apparatus of the present invention for producing a casting by pouring a metal melt into a gas-permeable casting mold by gravity, comprises:

a gas-permeable casting mold comprising a cavity including a sprue composed of a tubular portion and a cup portion having a larger diameter than that of the tubular portion to receive the metal melt, a runner constituting a flow path of the metal melt supplied through the sprue, and a product-forming cavity to be filled with the metal melt sent through the runner;

a means for pouring the metal melt into the sprue by gravity;

a gas-blowing unit comprising a gas-ejecting member to be connected to the sprue; and a mechanism for moving the gas-ejecting member;

the mechanism placing the gas-ejecting member at a position just above the tubular portion and not interfering with gravity pouring of the metal melt, and moving it downward for connection to the tubular portion; and the gas-blowing unit blowing a gas to fill the product-forming cavity with the metal melt.

The gas-ejecting member is preferably placed by the above mechanism such that its gas-ejecting port is below the upper edge of the cup portion.

The gas-ejecting member is preferably placed by the above mechanism such that its gas-ejecting port comes into contact with the melt residing in the cup portion.

The gas-ejecting member is preferably a tapered nozzle capable of being inserted into the tubular portion.

The pouring means preferably enables a melt stream to move between a position just above or near the tubular portion and a position away from the tubular portion within a region of the cup portion.

The cup portion preferably extends in one direction from the tubular portion. Such a cup portion preferably has a racetrack shape, and preferably becomes gradually shallower as separating from the tubular portion.

The casting apparatus of the present invention preferably comprises a means for detecting a surface of the melt residing in the sprue and outputting the detected signal; and a gas-ejecting-member-position-controlling means for receiving the output signal from the melt-surface-detecting means, and driving the gas-ejecting-member-moving mechanism to move the gas-ejecting member according to the signal.

The method of the present invention for producing a casting comprises the steps of pouring a metal melt by gravity into a gas-permeable casting mold comprising a cavity including a sprue composed of a tubular portion and a cup portion having a larger diameter than that of the tubular portion to receive the metal melt, a runner constituting a flow path of the metal melt supplied through the sprue, and a product-forming cavity to be filled with the metal melt sent through the runner; and then blowing a gas into the cavity of the gas-permeable casting mold from a gas-ejecting member of a gas-blowing unit, to fill the product-forming cavity with the metal melt;

the gas-ejecting member being placed at a position just above the tubular portion and not interfering with gravity pouring of the metal melt, and moved downward to the sprue for connection to the tubular portion after gravity-pouring ends.

In the method of the present invention, the gas-ejecting member is preferably placed such that its gas-ejecting port is below the upper edge of the cup portion.

In the method of the present invention, the gas-ejecting member is preferably placed such that its gas-ejecting port comes into contact with the melt residing in the cup portion.

The method of the present invention preferably comprises the steps of placing a stream of the melt, which is poured from a pouring means, at a position just above or near the tubular portion at an early stage of the pouring step, and moving the melt stream away therefrom within a region of the cup portion at an late stage of the pouring step.

The method of the present invention preferably comprises the step of controlling the position of the gas-ejecting member of the gas-blowing unit depending on a surface position of the melt residing in the sprue.

BRIEF DESCRIPTION OF THE DRAWINGS

FIG. 2(*b*) is a cross-sectional view showing another example of a cup portion of the casting apparatus.

FIG. 3(*b*) is a cross-sectional view showing a further example of a cup portion of the casting apparatus.

FIG. 4(*b*) is a cross-sectional view a further example of a cup portion of the casting apparatus.

FIG. 5(*b*) is a schematic cross-sectional view showing the casting apparatus of the present invention at a late stage of the pouring step.

FIG. 5(*c*) is a schematic cross-sectional view showing the casting apparatus of the present invention where a gas-blowing nozzle is connected after pouring ends.

FIG. 5(*d*) is a schematic cross-sectional view showing the casting apparatus of the present invention where a gas is blown into a cavity.

FIG. 7(*b*) is a schematic cross-sectional view showing the casting apparatus in Embodiment 1 at a late stage of the pouring step.

FIG. 7(*c*) is a schematic cross-sectional view showing the casting apparatus in Embodiment 1 where a gas-blowing nozzle is connected after pouring ends.

FIG. 7(*d*) is a schematic cross-sectional view showing the casting apparatus in Embodiment 1 where a gas is blown into a cavity.

FIG. 8(*b*) is a schematic cross-sectional view showing the casting apparatus in Embodiment 2 at a late stage of the pouring step.

FIG. 9(*b*) is a schematic cross-sectional view showing the casting apparatus in Embodiment 3 at a late stage of the pouring step.

FIG. 9(*c*) is a schematic cross-sectional view showing the casting apparatus in Embodiment 3 where a gas-blowing nozzle is connected after pouring ends.

FIG. 10(*b*) is a schematic cross-sectional view showing the casting apparatus in Embodiment 4 at a late stage of the pouring step.

FIG. 10(*c*) is a schematic cross-sectional view showing the casting apparatus in Embodiment 4 where a gas-blowing nozzle is connected after pouring ends.

FIG. 11(*b*) is a schematic cross-sectional view showing the casting apparatus in Embodiment 5 during the pouring step.

FIG. 11(*c*) is a schematic cross-sectional view showing the casting apparatus in Embodiment 5 at a late stage of the pouring step.

FIG. 11(*d*) is a schematic cross-sectional view showing the casting apparatus in Embodiment 5 where a gas-blowing nozzle is connected after pouring ends.

FIG. 12(*b*) is a schematic cross-sectional view showing the casting apparatus in Embodiment 6 during the pouring step.

FIG. 12(*c*) is a schematic cross-sectional view showing the casting apparatus in Embodiment 6 at a late stage of the pouring step.

FIG. 12(*d*) is a schematic cross-sectional view showing the casting apparatus in Embodiment 6 where a gas-blowing nozzle is connected after pouring ends.

DESCRIPTION OF THE PREFERRED EMBODIMENTS

[1] Casting Apparatus

In conventional gravity-casting, melt supply would not stagnate unless a casting apparatus, etc. were malfunctioned, because a sufficient amount of a melt is poured into a product-forming cavity by gravity. On the other hand, in casting in which a gravity-pouring step is followed by a gas-blowing step, as proposed by JP 2007-75862 A and JP 2010-269345 A, the stagnation of melt supply, if any, should end in a short period of time while switching the steps, to avoid the deterioration of product quality.

In view of this, the casting apparatus of the present invention comprises a gas-blowing unit placed at a position just above a sprue and not interfering with a pouring means at least during gravity-pouring, such that the gas-blowing unit can be quickly connected to the sprue after pouring ends. Such a structure can shorten the stagnation of melt supply into the product-forming cavity. The present invention will be explained in detail below.

The casting apparatus of the present invention for producing a casting by pouring a metal melt into a gas-permeable casting mold by gravity, comprises:

a gas-permeable casting mold comprising a cavity including a sprue composed of a tubular portion and a cup portion having a larger diameter than that of the tubular portion to receive the metal melt, a runner constituting a flow path of the metal melt supplied through the sprue, and a product-forming cavity to be filled with the metal melt sent through the runner;

a means for pouring the metal melt into the sprue by gravity;

a gas-blowing unit comprising a gas-ejecting member to be connected to the sprue; and a mechanism for moving the gas-ejecting member in a vertical direction, or in vertical and horizontal directions;

the gas-ejecting-member-moving mechanism placing the gas-ejecting member at a position just above the tubular portion and not interfering with gravity pouring of the metal melt, and moving it downward for connection to the tubular portion; and the gas-blowing unit blowing a gas to fill the product-forming cavity with the metal melt.

Figure 1:
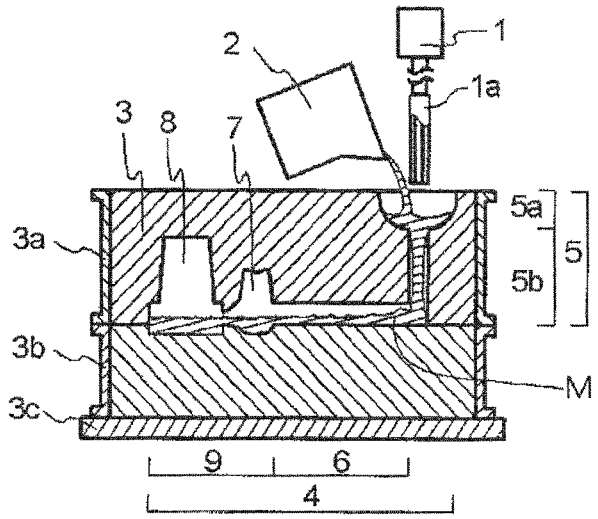
FIG. 1 is a schematic cross-sectional view showing an example of the casting apparatus of the present invention.

As shown in FIG. 1, for example, the casting apparatus of the present invention comprises a gas-blowing unit 1 having a gas-blowing nozzle (gas-ejecting member) 1*a*, a ladle (pouring means) 2, and a casting mold (gas-permeable casting mold) 3. The casting mold 3 with an upper flask 3*a* and a lower flask 3*b* combined is placed on a bottom board 3*c*. A casting mold cavity 4 is composed of a sprue 5 comprising a cup portion 5*a* and a tubular portion 5*b* to constitute a flow path of the melt, a runner 6, a feeder 7, and a product-forming cavity 8. In Embodiment 1, the desired cavity 9 to be filled with the metal melt is composed of the product-forming cavity 8 and the feeder 7. The feeder 7 may be omitted, if unnecessary.

(1) Gas-Permeable Casting Mold

The gas-permeable casting mold for producing a casting by pouring the metal melt by gravity comprises a cavity including a sprue into which the metal melt is poured, a runner constituting a flow path of the metal melt supplied through the sprue, and a product-forming cavity to be filled with the melt sent through the runner. The cavity may include a feeder, if necessary.

The gas-permeable casting mold is generally formed by sand particles such as a green sand mold, a shell mold and a self-hardening mold, and may be formed by ceramic or metal particles. The gas-permeable casting mold could be formed by materials having substantially no gas permeability, such as gypsum, if gas-permeable materials were mixed, or partially gas-permeable materials were used to have sufficient gas permeability. Even a mold made of a material having no gas permeability at all, such as a metal die, can be used as a gas-permeable casting mold, when gas permeability is given by gas-flowing holes such as vents.

The sprue comprises a tubular portion constituting a flow path to the runner, and a cup portion having a larger diameter than that of the tubular portion to receive the metal melt poured from the pouring means. That is, the cup portion has a larger opening than that of the tubular portion. With such a cup portion having a larger opening, the sprue can receive the melt poured from the pouring means by gravity, even when the pouring means retreats from an operation range of the gas-blowing unit, thereby efficiently pouring the melt into the sprue by gravity until pouring ends. When a more melt than flowing down through the tubular portion is poured from the pouring means, the cup portion acts as a temporary storage of the melt, especially at an early stage of the pouring step, thereby preventing the melt from overflowing the casting mold.

Figure 2A:
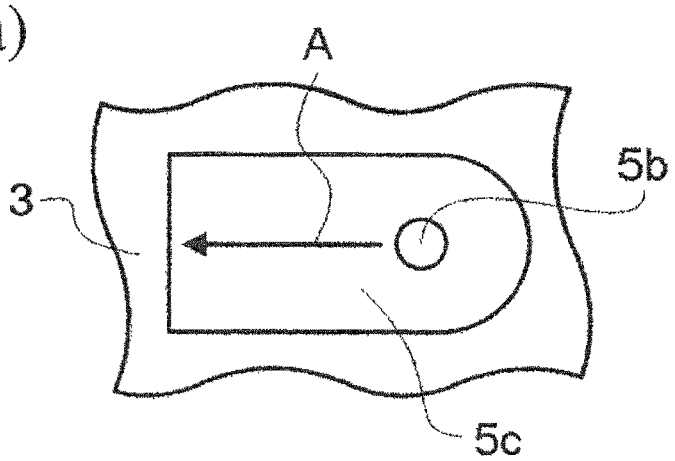
FIG. 2(*a*) is a plan view showing another example of a cup portion of the casting apparatus.
Figure 2B:
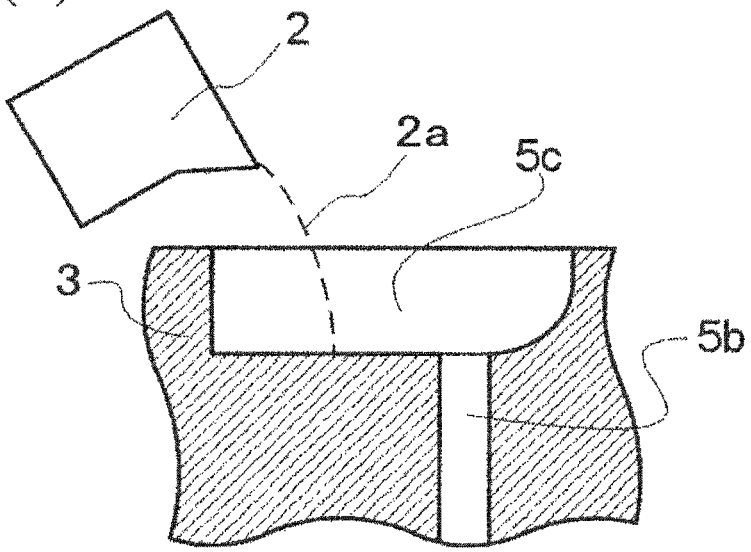

The cup portion having a larger opening than the tubular portion has such a shape as a bowl-like, conical, pyramidal, truncated conical, or truncated pyramidal shape. With the cup portion having a large opening, the pouring means can retreat to a wide area. In the simplest apparatus permitting the pouring means to move in one direction as shown in FIGS. 2(*a*) and 2(*b*), however, the cup portion 5*c* preferably extends in a direction in which the pouring means moves from the tubular portion 5*b*.

Figure 3A:
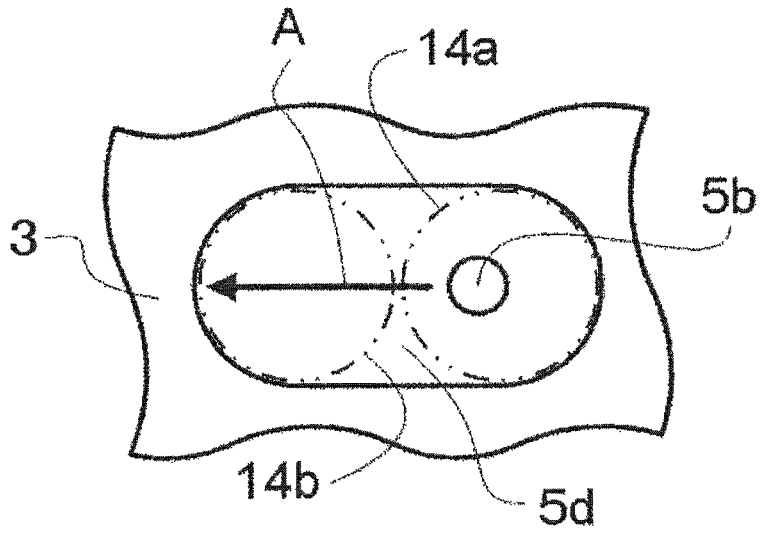
FIG. 3(*a*) is a plan view showing a further example of a cup portion of the casting apparatus.
Figure 3B:
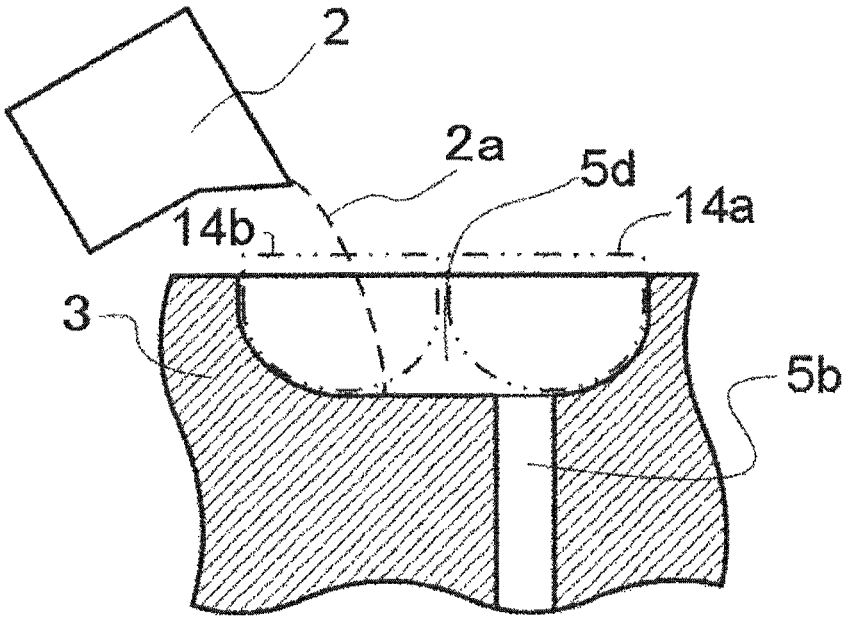
Figure 4A:
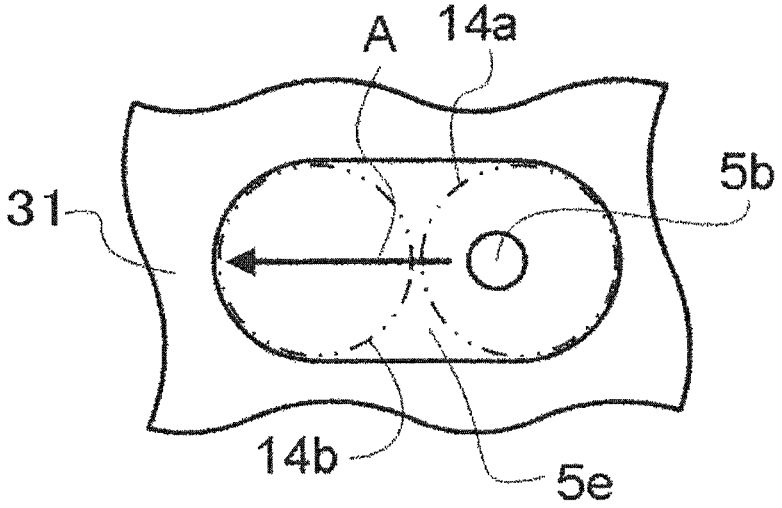
FIG. 4(*a*) is a plan view showing a further example of a cup portion of the casting apparatus.
Figure 4B:
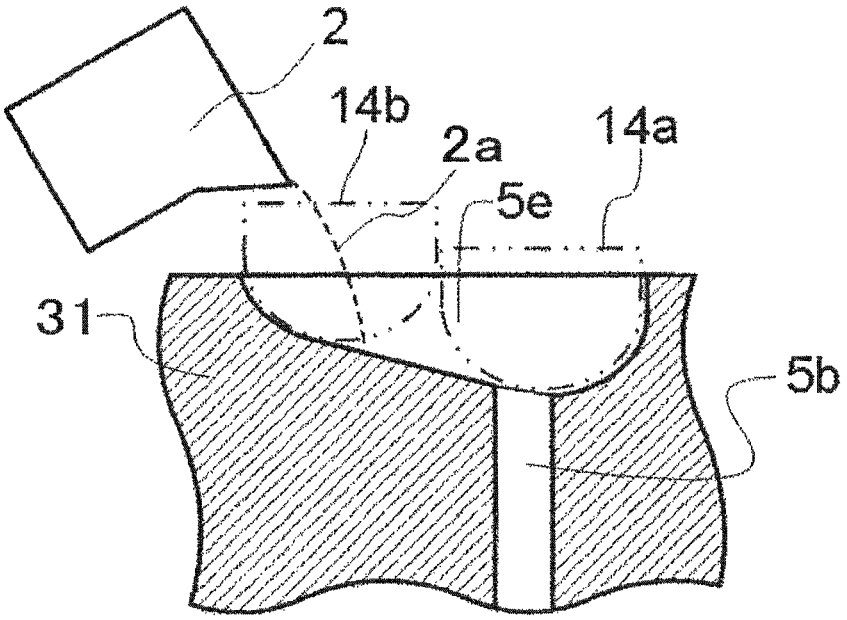
Figure 5A:
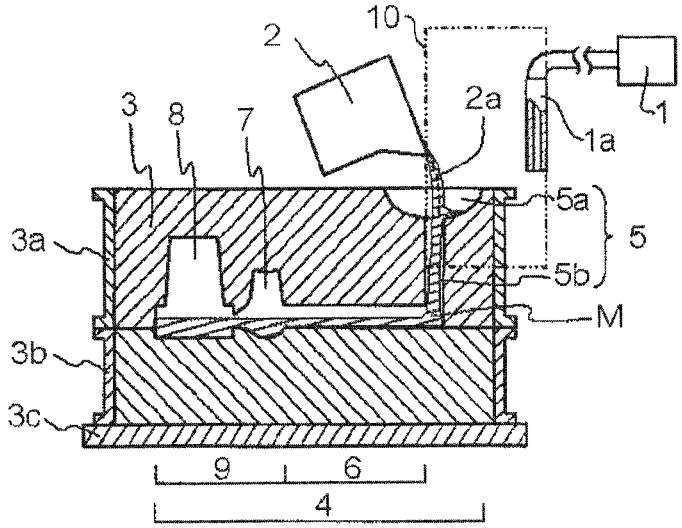
FIG. 5(*a*) is a schematic cross-sectional view showing the casting apparatus of the present invention at an early stage of the pouring step.
Figure 5B:
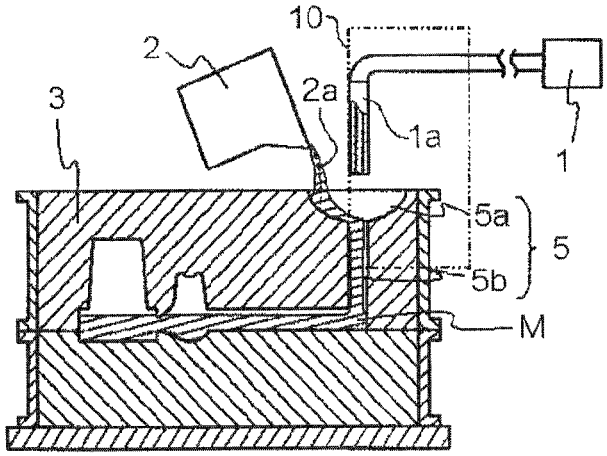
Figure 5C:
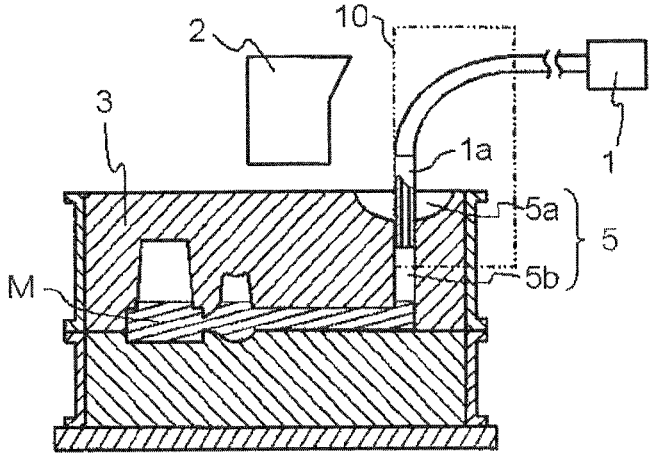
Figure 5D:
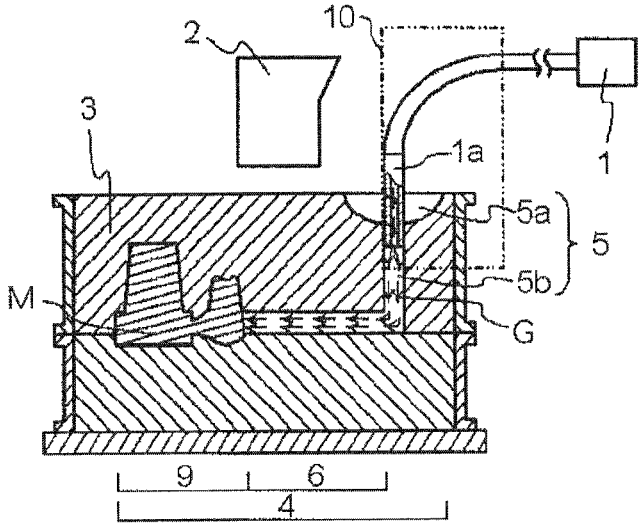

The cup portion may be generally formed by rotating a flat sprue cutter having a U-shaped edge. Such a sprue cutter can easily form a bowl-like or conical shape, which may be laterally stretched. For instance, by moving the sprue cutter for forming a cup-like recess laterally from the upper end of the tubular portion, as shown in FIGS. 3(*a*) and 3(*b*), it is possible to form a racetrack-shaped cup portion 5*d* having such a shape that two bowl-like or conical recesses 14*a*, 14*b* are combined. As shown in FIGS. 4(*a*) and 4(*b*), the cup portion 5*e* may become gradually shallower as separating from the tubular portion, so that the melt can enter the tubular portion more quickly.

(2) Pouring Means

The pouring means may be a ladle, a pouring pipe, a pouring gutter, etc. For quick switching from a gravity-pouring step to a gas-blowing step, a gas-ejecting member described below should be able to be moved downward and connected to the sprue, immediately after pouring ends. To this end, the pouring means should not interfere with the gas-ejecting member to be connected to the tubular portion at least in the connecting step. That is, the pouring means should retreat from an operation range of the gas-ejecting member until pouring ends. The pouring means is more preferably located at a position away from an operation range of the gas-ejecting member before and during the pouring step.

The melt may be poured from the pouring means, for instance, by (a) pouring the melt to the tubular portion or its vicinity in the entire period of the pouring step; (b) pouring the melt to the tubular portion or its vicinity at an early stage of the pouring step, and then moving a stream of the melt away therefrom at a late stage of the pouring step; or (c) pouring the melt to a position away from the tubular portion in the cup portion having a larger opening, since an early stage of the pouring step. The pouring position of the melt can be controlled, for instance, by adjusting a tilt angle of the ladle used as the pouring means, or by using a pouring-means-moving unit described below.

Although the process (a) can most efficiently have the melt flow into the tubular portion, it may bring a melt stream into contact with the gas-ejecting member brought close to the tubular portion, thereby splashing the melt around, likely resulting in lower safety and shortage of the melt flowing into the tubular portion. Although the process (c) can place the gas-ejecting member close to the tubular portion at the early stage, it is less efficient in flowing the melt into the tubular portion than the processes (a) and (b). In addition, it inevitably brings all the melt into contact with an inner surface of the cup portion since an early stage of the pouring step, resulting in increase in damages of the cup portion due to the melt, inclusion of foreign matters, oxidation of the melt, etc. Accordingly, the process (b) is preferable because it has sufficient efficiency in flowing the melt into the tubular portion, without bringing the melt stream into contact with the gas-ejecting member brought close to the tubular portion.

(3) Pouring-Means-Moving Unit

As described above, the casting apparatus preferably comprises a pouring-means-moving unit, as a unit for moving the pouring means away from an operation range of the gas-ejecting member until pouring ends, and/or as a unit for placing the melt stream at a position just above or near the tubular portion at an early stage of the pouring step, and then appropriately moving it away therefrom within the cup portion at a late stage of the pouring step. This pouring-means-moving unit can move the pouring means away from an operation range of the gas-blowing unit until pouring ends, making it possible to quickly move the gas-ejecting member downward for connection to the tubular portion after pouring ends, thereby suppressing melt splashing due to the contact of the melt stream with the gas-ejecting member, damages of the cup portion due to the melt, inclusion of foreign matters, and oxidation of the melt.

A simple method of moving the pouring means in one direction (horizontal direction) from the tubular portion is preferable.

(4) Gas-Blowing Unit

The gas-blowing unit comprises a gas flow generator and a gas-ejecting member having a portion to be connected to the sprue. The gas-ejecting member is placed at a position just above the tubular portion and not interfering with gravity pouring from the pouring means, by a gas-ejecting-member-moving mechanism described below; and then moved downward for connection to the tubular portion after the pouring ends. Subsequently, a gas is blown from the gas flow generator to push the melt into the product-forming cavity.

The gas flow generator may be a fan, a blower, etc. for supplying a gas flow, a compressor for generating a compressed gas flow, etc. The compressed gas is preferable because it can uniformly push the melt with larger pressure.

While the entire gas-blowing unit may be moved for connection to the sprue, only part of the gas-blowing unit, a gas-ejecting member, is preferably moved by the gas-ejecting-member-moving mechanism described below. This makes it possible to connect the gas-ejecting member to the sprue, to introduce the gas blown from the gas-blowing unit into the casting mold, and to efficiently fill the desired cavity with the poured melt, with lower energy in a shorter period of time than when the entire gas-blowing unit is moved.

The gas-ejecting member of the gas-blowing unit is preferably a nozzle. Fit into the sprue, the nozzle can be quickly connected to the sprue without gas leak. The nozzle preferably has a tapered side surface for easy fitting. When the sprue has a tapered side wall, the nozzle can be surely fit into the sprue.

Because the gas-ejecting member is exposed to a high-temperature melt, it is preferably made of refractory materials, graphite, alumina-graphite, silicon nitride, sialon, etc.

Though not restrictive, the gas used in the present invention may be air from the aspect of cost, or a non-oxidizing gas such as argon, nitrogen and carbon dioxide from the aspect of preventing the oxidation of the melt. Together with the gas, a cooling medium such as mist to accelerate cooling, or solid materials such as refractory particles as shown in JP 2010-269345 A to shut the runner off, may be supplied.

(5) Gas-Ejecting-Member-Moving Mechanism

With the gas-ejecting-member-moving mechanism, the gas-ejecting member, which is at a position just above the tubular portion and not interfering with gravity pouring from the pouring means at least during the pouring step, is moved downward for connection to the tubular portion. The gas-ejecting member is connected to the sprue, for instance, by three steps of (i) placing the gas-ejecting member at a position just above the tubular portion of the sprue and not interfering with gravity pouring from the pouring means, (ii) bringing it close to the sprue, and (iii) connecting it to the tubular portion. A time required for each step (i) to (iii) should be shortened to quickly switch the gravity-pouring step to the gas-blowing step.

At least at the end of pouring, the gas-ejecting member should be placed at a position just above the tubular portion of the sprue and not interfering with gravity pouring from the pouring means, as shown in FIG. 1. Before the pouring step begins or at an early stage of the pouring step, the gas-ejecting member may be placed at a position horizontally away from the tubular portion 5*b* of the sprue 5 as shown in FIG. 5(*a*), and then moved to a position just above the tubular portion 5*b* of the sprue and not interfering with gravity pouring of the metal melt as shown in FIG. 5(*b*).

"Placing the gas-ejecting member at a position just above the tubular portion 5*b*" means that the gas-blowing nozzle (gas-ejecting member) 1*a* is stopped at an arbitrary vertical position above the tubular portion 5*b* for a certain period of time or for a moment (not excluding direction change from a horizontal direction to a vertical direction, vertical direction change, etc.), or slightly moving to follow a melt surface, etc. Hereinafter, these variations may be simply called "placing."

The gas-blowing nozzle 1*a* is placed at a position horizontally away from the tubular portion 5*b* of the sprue 5, before the pouring step begins, or at an early stage of the pouring step; moved to a position just above the tubular portion 5*b* and not interfering with gravity pouring of the metal melt during pouring [FIG. 5(*b*)]; and then moved downward for connection to the tubular portion 5*b* of the sprue 5 after pouring ends [FIG. 5(*c*)], to connect the gas-blowing nozzle 1*a* to the sprue 5, as described above.

On the other hand, as shown in FIG. 1, in a case where the gas-blowing nozzle 1*a* is placed at a position just above the tubular portion of the sprue 5 and not being prevented from moving downward by the pouring means before the pouring step begins, it is moved downward directly from the upper position for connection to the tubular portion 5*b* of the sprue 5 after pouring ends. The gas-blowing nozzle 1*a* may be moved downward during the pouring step. Such an operation of moving the gas-blowing nozzle 1*a* downward is the simplest in the above steps (i) and (ii), thereby saving a time.

To shorten a time required for the step (ii) where the gas-ejecting member is brought close to the sprue, the gas-ejecting member is preferably placed such that its gas-ejecting port is below the upper edge of the cup portion. This makes the gas-ejecting member of the gas-blowing unit close to the tubular portion, thereby saving a time to connect the gas-blowing unit to the tubular portion. In this case, the gas-ejecting member of the gas-blowing unit may be moved downward to follow a lowering melt surface, as the melt pooled in the cup portion flows down into the tubular portion during the pouring step.

The gas-ejecting member at a position away from the tubular portion of the sprue may be first horizontally moved to a position just above the tubular portion of the sprue during the pouring step, and then moved downward to a position such that its gas-ejecting port is below the upper edge of the cup portion; or may be directly moved to a position at which its gas-ejecting port is below the upper edge of the cup portion.

The "during the pouring step" used herein means a time period from the beginning of pouring the melt from the pouring means to the cup portion of the sprue to the end of flowing the melt in the cup portion into the tubular portion. The term "the end of flowing the melt in the cup portion into the tubular portion" means a time at which the flowing of a sufficient melt to fill the product-forming cavity into the tubular portion is completed, though the melt may remain in the cup portion.

The gas-ejecting port of the gas-ejecting member preferably comes into contact with the melt in the cup portion, making the gas-ejecting member close to the tubular portion, thereby shortening a time required for the step (ii). In this case, the gas-ejecting port may enter the melt in the cup portion. To prevent the melt from intruding into the gas-ejecting member through the gas-ejecting port, the gas-blowing unit may blow a gas during the pouring step.

To place the gas-ejecting member close to the melt in the cup portion, the casting apparatus preferably comprises a means for detecting the melt surface in the sprue and outputting the detected signal; and a gas-ejecting-member-position-controlling means for receiving output signal from the melt-surface-detecting means, and driving a gas-ejecting-member-moving mechanism to move the gas-ejecting member according to the signal. With the melt-surface-detecting means and the gas-ejecting-member-position-controlling means, the gas-ejecting member can be automatically positioned to keep a proper distance between the gas-ejecting member and the melt, even if the melt in the cup portion has a varying surface, which is unavoidable in mass production that the melt is continuously poured by gravity into a plurality of gas-permeable casting molds.

Figure 6:
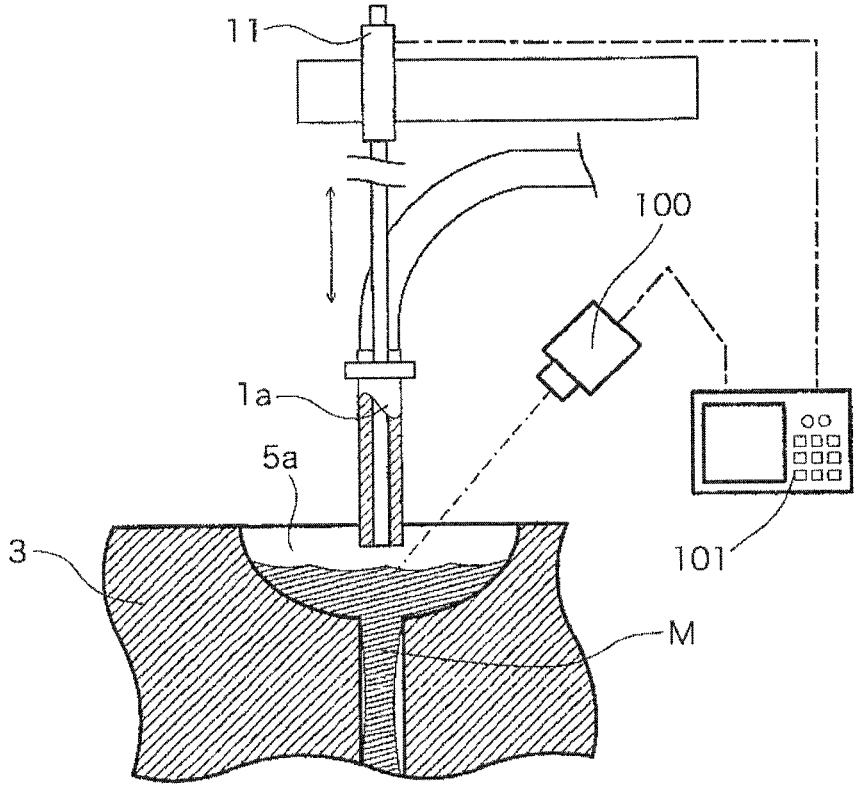
FIG. 6 is a schematic view showing a method of controlling a melt-surface-detecting means and a gas-ejecting-member-moving mechanism.
Figure 7A:
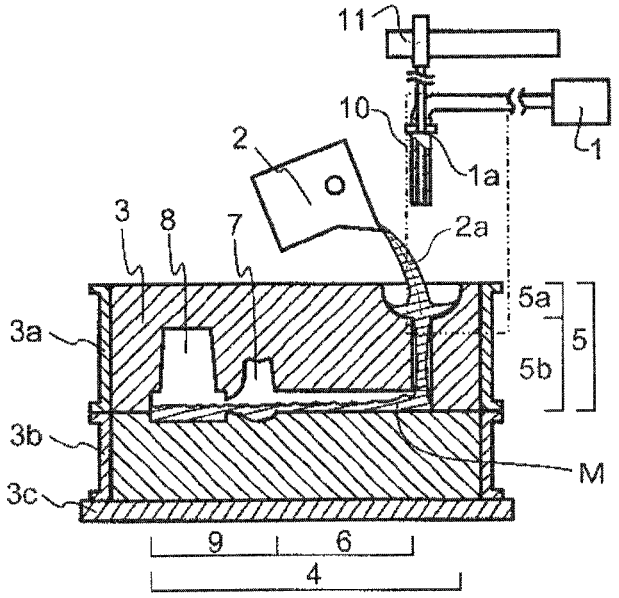
FIG. 7(*a*) is a schematic cross-sectional view showing the casting apparatus in Embodiment 1 at an early stage of the pouring step.
Figure 7B:
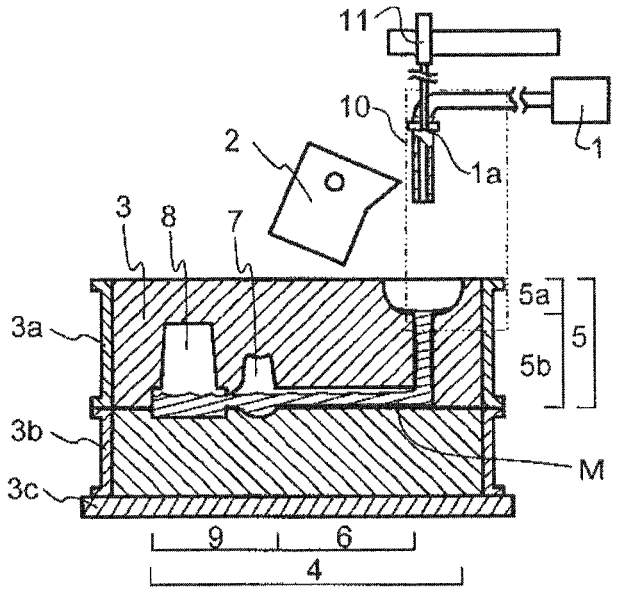
Figure 7C:
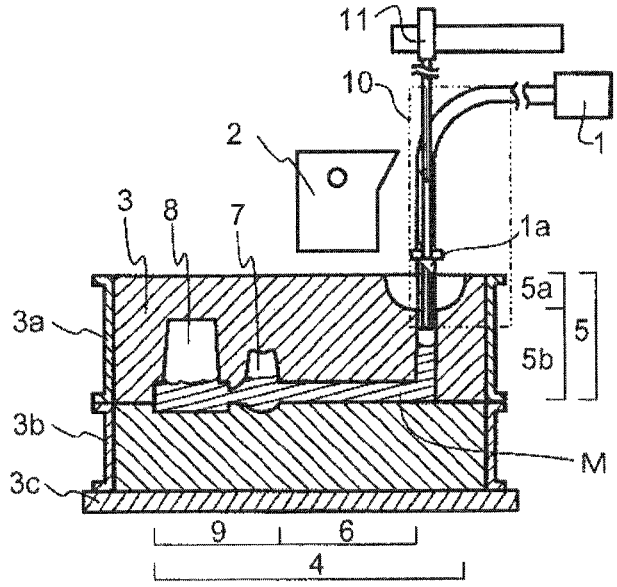
Figure 7D:
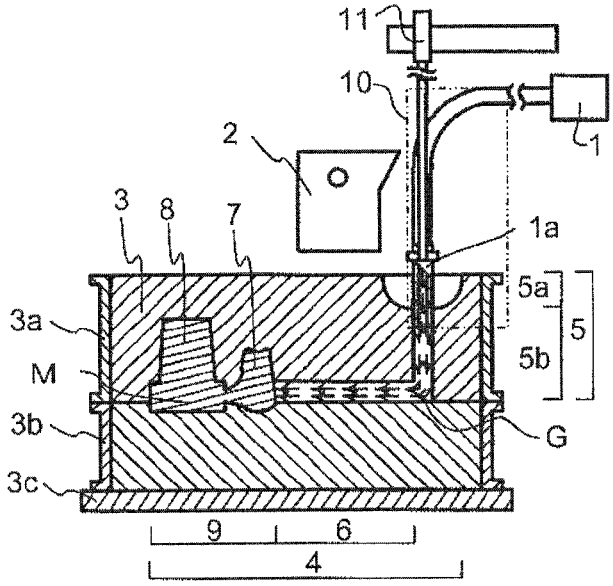

The gas-ejecting-member-position-controlling means is, for instance, a robot comprising, as shown in FIG. 6, a computer 101 including an AD converter for digitalizing a signal sent from a melt-surface-detecting means 100, a memory for storing digitized information, various set values, an arithmetic processing program, etc., and a CPU for arithmetically processing various information according to the program; and a gas-ejecting-member-moving mechanism 11 driven by an electric motor, an oil pressure, an air pressure, etc. under the control of the computer 101. The melt-surface-detecting means 100 may be a non-contact detecting means such as a visible-light or infrared camera, a laser displacement gauge, etc.; or a contact-detecting means such as a melt-surface-detecting rod, etc. The signal of the melt level measured by the melt-surface-detecting means 100 is transmitted to the computer 101, which determines the position of the gas-blowing nozzle 1*a* according to the information of the melt level, and then commands the gas-ejecting-member-position-controlling means to place the gas-blowing nozzle 1*a* at that position.

The casting apparatus of the present invention comprising the melt-surface-detecting means and the gas-ejecting-member-position-controlling means is preferable, though not restrictive, because it can conduct the following operations automatically.

One example is that when the detected melt surface at a position just above the tubular portion becomes below the opening of the tubular portion, the gas-ejecting member is automatically moved downward for connection to the tubular portion.

Another example is that the gas-ejecting port of the gas-ejecting member is controlled to closely follow a lowering surface of the melt in the cup portion without contact, during the pouring step. This example is preferable because the gas-ejecting member is placed at a position just above and very close to the tubular portion while avoiding direct contact with the high-temperature melt, so that it can be connected to the sprue in an extremely short period of time after pouring ends.

[2] Embodiments

(1) Embodiment 1

As shown in FIG. 7(*a*), the casting apparatus in Embodiment 1 comprises a gas-blowing unit 1 having a gas-blowing nozzle (gas-ejecting member) 1*a*, a mechanism 11 for moving the gas-blowing nozzle 1*a* in vertical and horizontal directions, a ladle (pouring means) 2, and a casting mold (gas-permeable casting mold) 3. The casting mold 3 with an upper flask 3*a* and a lower flask 3*b* combined is placed on a bottom board 3*c*. A casting mold cavity 4 is composed of a sprue 5 comprising a cup portion 5*a* and a tubular portion 5*b* to constitute a flow path of the melt, a runner 6, a feeder 7, and a product-forming cavity 8. In Embodiment 1, the desired cavity 9 is composed of the product-forming cavity 8 and the feeder 7. The feeder 7 may be omitted if unnecessary. The gas-blowing nozzle 1*a* has a taper-free side surface, the casting mold 3 is a gas-permeable green sand mold, and the cup portion 5*a* has a bowl-like shape having a diameter increasing from a center axis of the tubular portion 5*b*, though not restrictive.

At an early stage of the pouring step, as shown in FIG. 7(*a*), the ladle 2 is placed outside an operation range 10 (surrounded by a two-dot chain line) of the gas-blowing nozzle. The melt M is poured in the form of a stream 2*a* from the ladle 2 into the cup portion 5*a*, and then supplied to the product-forming cavity through the tubular portion 5*b*, the runner 6 and the feeder 7. The gas-blowing nozzle 1*a* is placed at a position just above the tubular portion 5*b* and not interfering with gravity pouring of the melt M from the pouring means 2. Because the stream 2*a* is cast to or near the tubular portion 5*b*, the melt M can efficiently flow into the tubular portion 5*b* in a short period of time, without splashing from the cup portion 5*a*. It should be noted that as long as the gas-blowing nozzle 1*a* is located at this position at least at the end of pouring, the gas-blowing nozzle 1*a* may be placed at other positions at an early stage of pouring (the same is true in Embodiments 2 to 6).

FIG. 7(*b*) shows a state where the melt M resides in the cup portion 5*a* after the ladle 2 stops pouring the melt M at a late stage of the pouring step.

Immediately after the melt M in the cup portion 5*a* fully flows into the tubular portion 5*b*, as shown in FIG. 7(*c*), the gas-blowing nozzle 1*a* is moved downward by the gas-ejecting-member-moving mechanism 11 to be fit into the tubular portion 5*b*.

After connecting the gas-blowing nozzle 1*a* to the tubular portion 5*b*, as shown in FIG. 7(*d*), a gas G (shown by arrows) is supplied from the gas-blowing nozzle 1*a* of the gas-blowing unit 1 into the casting mold cavity 4, before the melt M begins to be solidified. The melt M is pushed by the gas G into the cavity 9 comprising the product-forming cavity 8.

In Embodiment 1, because the gas-blowing nozzle 1*a* is placed at a position just above the tubular portion 5*b* and not interfering with gravity pouring of the melt M, it can be simply moved downward for quick connection to the sprue 5.

(2) Embodiment 2

A part of the ladle 2 is within the operation range 10 (surrounded by a two-dot chain line) at an early stage of the pouring step in Embodiment 2, while the ladle 2 is placed outside the operation range 10 (surrounded by a two-dot chain line) at an early stage of the pouring step in Embodiment 1.

Figure 8A:
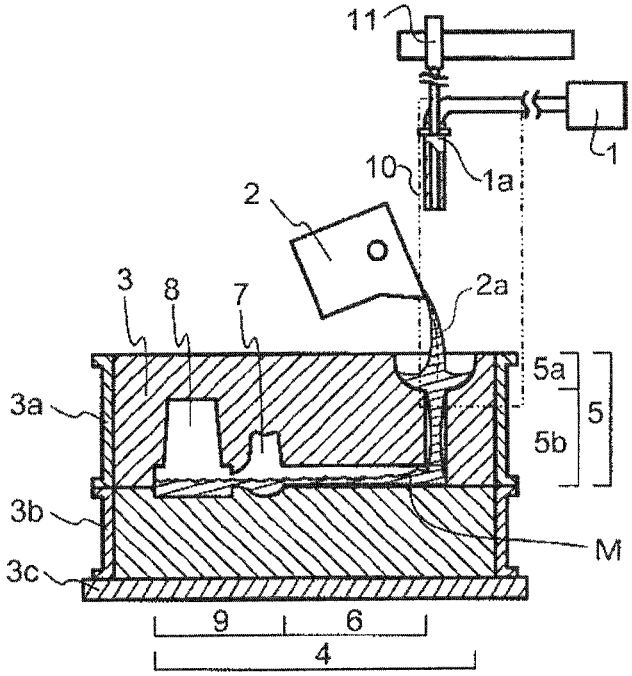
FIG. 8(*a*) is a schematic cross-sectional view showing the casting apparatus in Embodiment 2 at an early stage of the pouring step.
Figure 8B:
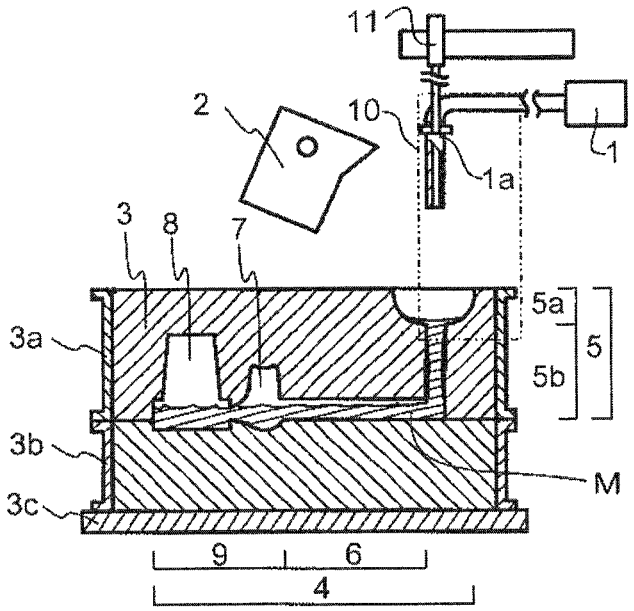

When a part of the ladle 2 is within the operation range 10 (surrounded by a two-dot chain line) as shown in FIG. 8(*a*), the ladle 2 retreats from the operation range 10 (surrounded by a two-dot chain line) by adjusting tilt angle and/or horizontal movement, until pouring ends at a late stage of the pouring step, that is, from the end of pouring the melt M from the ladle 2 to the end of flowing the melt M in the cup portion 5*a* into the tubular portion 5*b*, as shown in FIG. 8(*b*).

In Embodiment 2, because the ladle 2 retreats from the operation range 10 (surrounded by a two-dot chain line) by adjusting tilt angle and/or horizontal movement until pouring ends, the gas-blowing unit 1 can be quickly connected to the sprue 5.

(3) Embodiment 3

Embodiment 3 is the same as Embodiment 1, except that a tip end (gas-ejecting port) of the gas-blowing nozzle 1*a* is placed below the upper edge of the cup portion 5*a*, until pouring ends at a late stage of the pouring step.

Figure 9A:
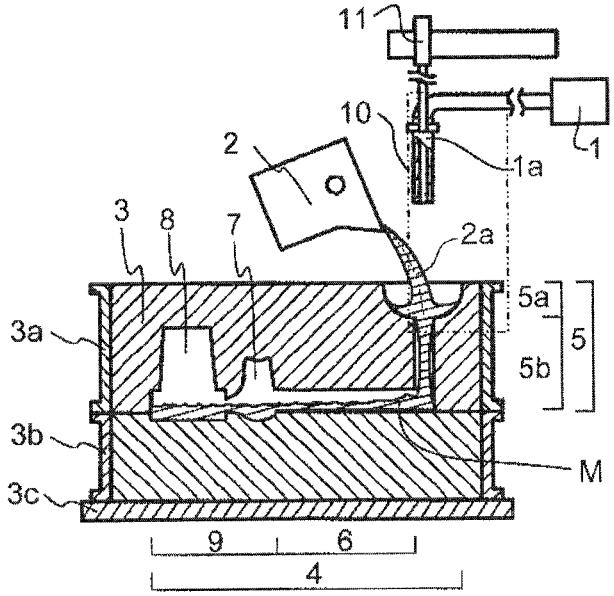
FIG. 9(*a*) is a schematic cross-sectional view showing the casting apparatus in Embodiment 3 at an early stage of the pouring step.
Figure 9B:
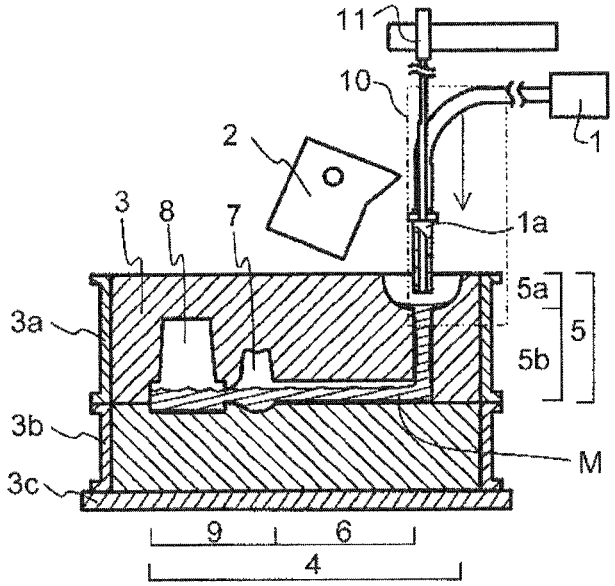
Figure 9C:
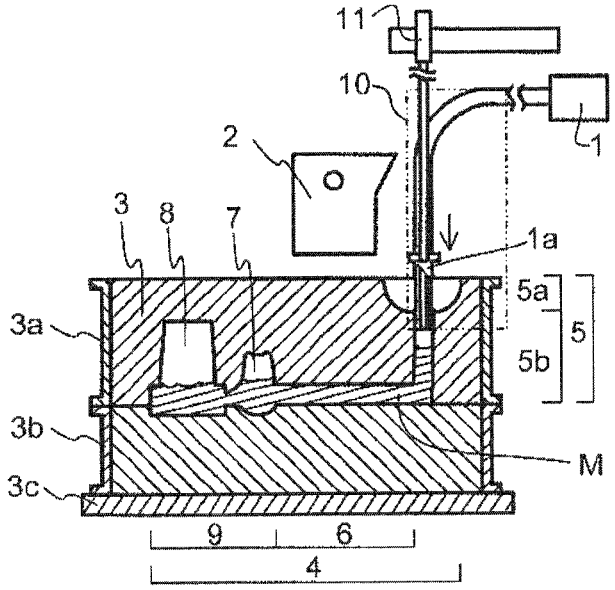

With the ladle 2 placed outside the operation range 10 (surrounded by a two-dot chain line) at an early stage of the pouring step, as shown in FIG. 9(*a*), the gas-blowing nozzle 1*a* is moved by the gas-ejecting-member-moving mechanism 11 to such a position that its tip end (gas-ejecting port) is below the upper edge of the cup portion 5*a*, immediately after pouring the melt M from the ladle 2 ends, and while it resides in the cup portion 5*a* without completely flowing into the tubular portion 5*b* at a late stage of the pouring step, as shown in FIG. 9(*b*).

Immediately after gravity-pouring ends, that is, immediately after the melt M residing in the cup portion 5*a* fully flows into the tubular portion 5*b*, as shown in FIG. 9(*c*), the gas-blowing nozzle 1*a* is moved downward by the gas-ejecting-member-moving mechanism 11 to be fit into the tubular portion 5*b*.

Because the gas-blowing nozzle 1*a* is placed at such a position that its tip end (gas-ejecting port) is below the upper edge of the cup portion 5*a* at least at the end of gravity-pouring, the gas-blowing nozzle 1*a* is close to the tubular portion 5*b*, thereby saving a time taken to connect the gas-blowing nozzle 1*a* to the tubular portion 5*b*.

(4) Embodiment 4

Embodiment 4 is the same as Embodiment 1, except that the gas-blowing nozzle 1*a* is placed such that its tip end (gas-ejecting port) comes into contact with the melt M in the cup portion 5*a*, until pouring ends at a late stage of the pouring step.

Figure 10A:
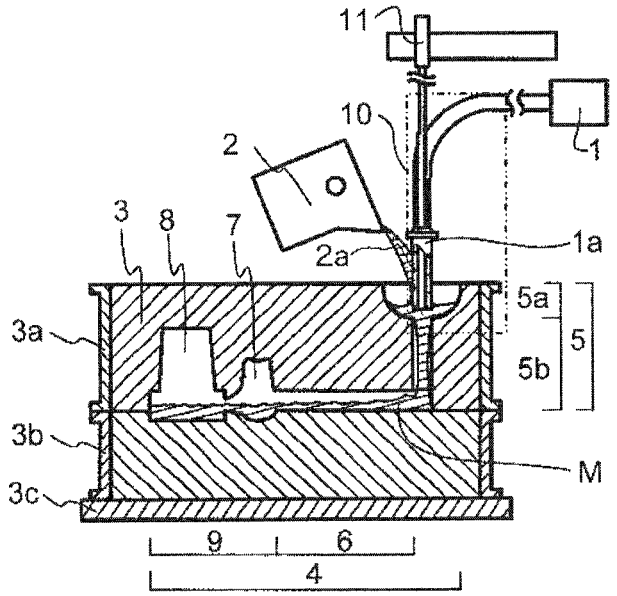
FIG. 10(*a*) is a schematic cross-sectional view showing the casting apparatus in Embodiment 4 at an early stage of the pouring step.
Figure 10B:
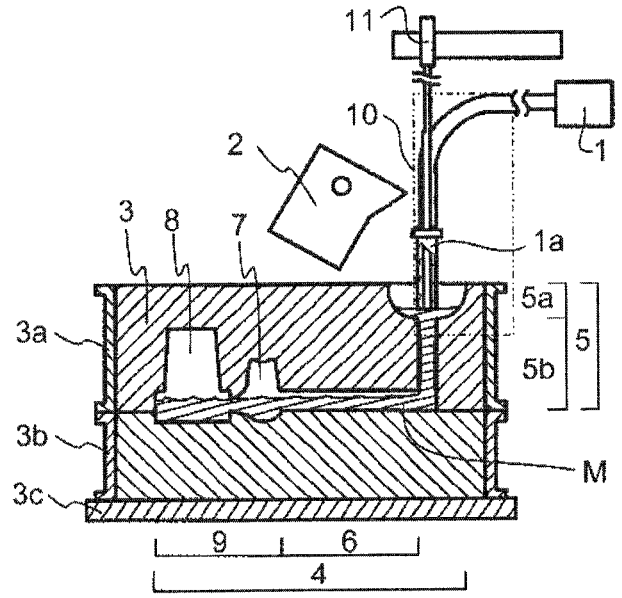
Figure 10C:
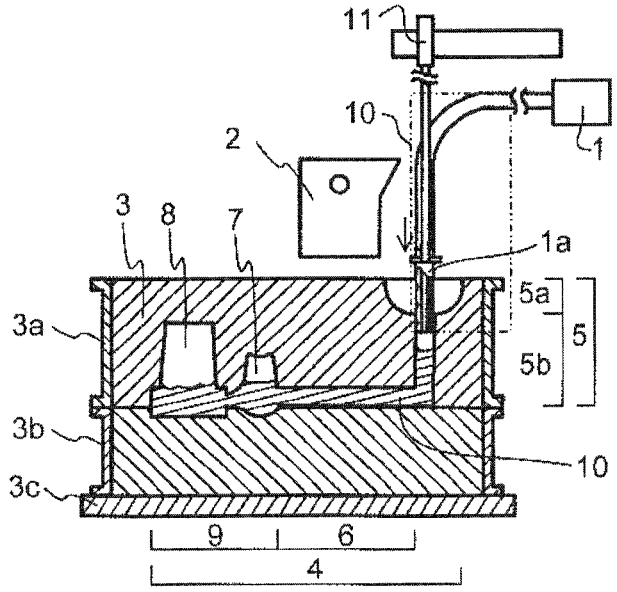
Figure 11A:
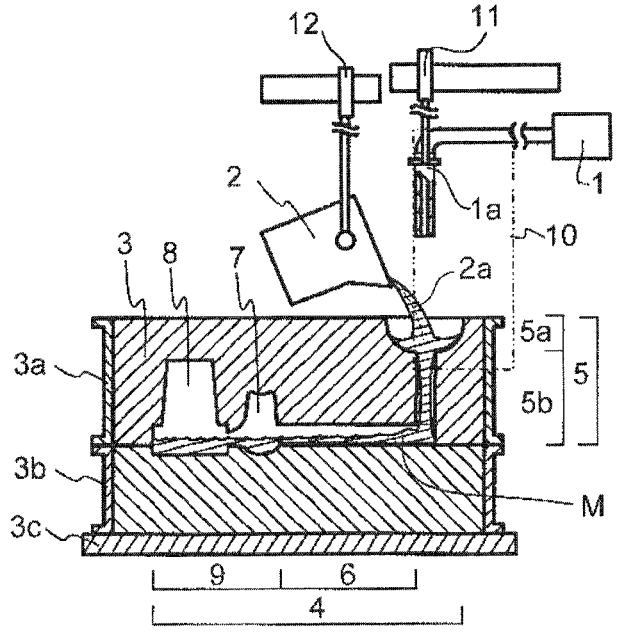
FIG. 11(*a*) is a schematic cross-sectional view showing the casting apparatus in Embodiment 5 at an early stage of the pouring step.
Figure 11B:
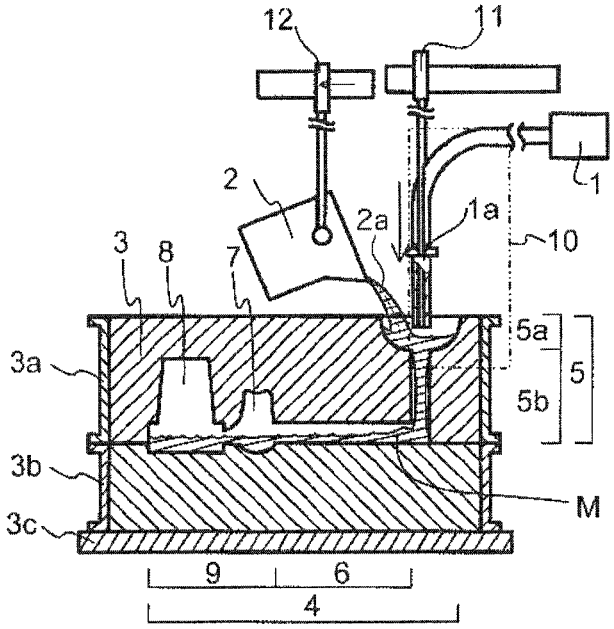
Figure 11C:
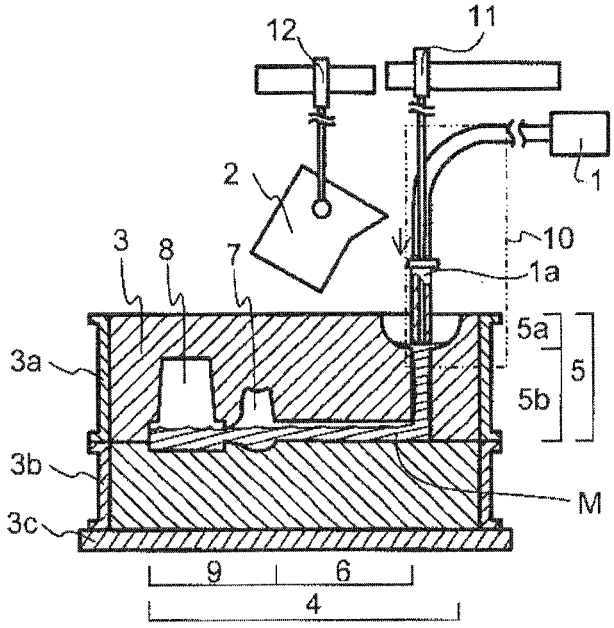
Figure 11D:
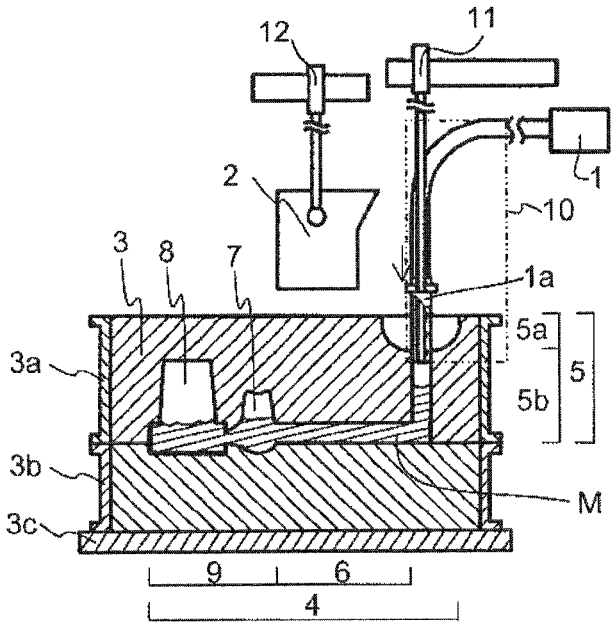
Figure 12A:
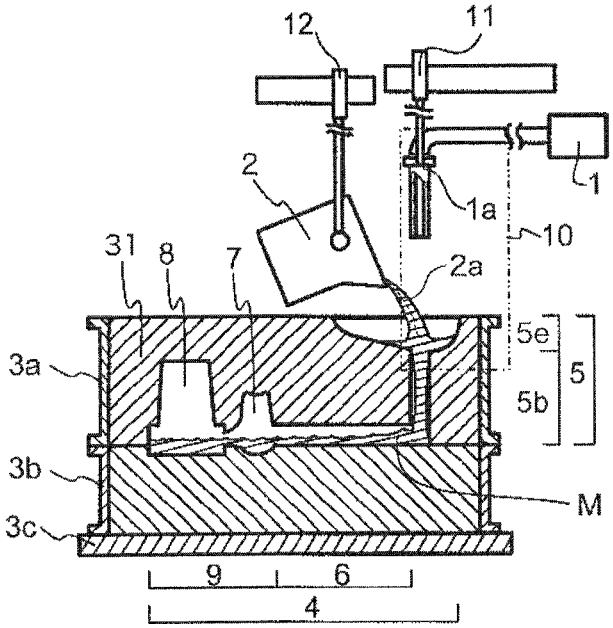
FIG. 12(*a*) is a schematic cross-sectional view showing the casting apparatus in Embodiment 6 at an early stage of the pouring step.
Figure 12B:
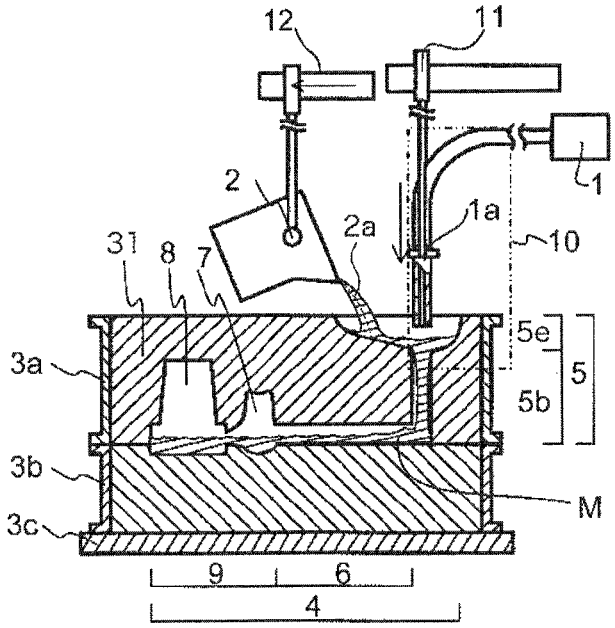
Figure 12C:
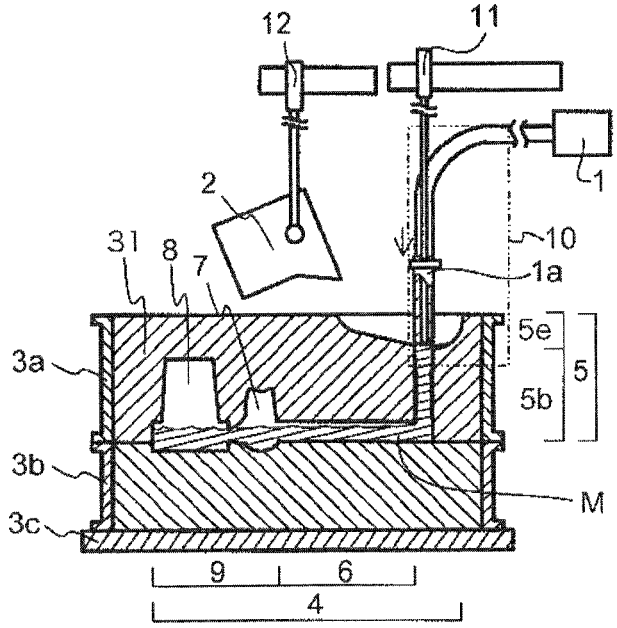
Figure 12D:
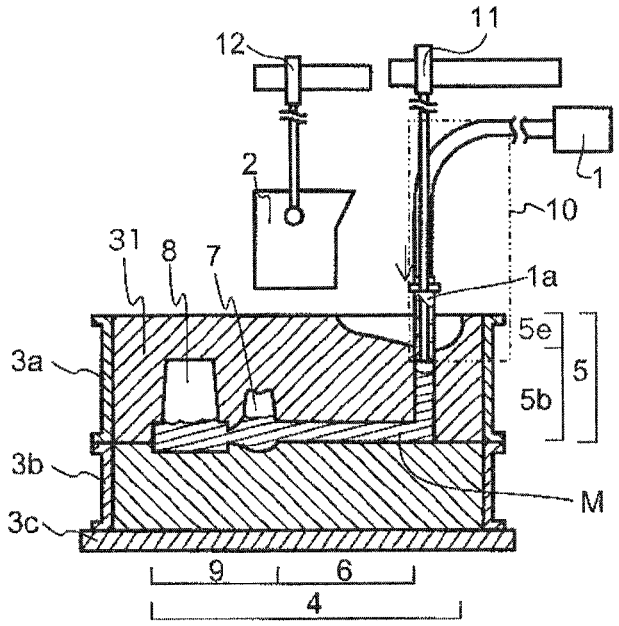

With the ladle 2 placed outside the operation range 10 (surrounded by a two-dot chain line) at an early stage of the pouring step, as shown in FIG. 10(*a*), the gas-blowing nozzle 1*a* can be moved by the gas-ejecting-member-moving mechanism 11, without interfering with the ladle 2, to come into contact with the melt M in the cup portion 5*a*. The tip end (gas-ejecting port) of the gas-blowing nozzle 1*a* may enter the melt M residing in the cup portion 5*a*.

FIG. 10(*b*) shows a state immediately after the ladle 2 stops pouring the melt M at a late stage of the pouring step, in which the tip end (gas-ejecting port) of the gas-blowing nozzle 1*a* is in contact with the melt M residing in the cup portion 5*a*. The gas-blowing nozzle 1*a* may be controlled to follow a lowering surface of the melt M in the cup portion 5*a*, which flows into the tubular portion 5*b*.

Immediately after gravity-pouring ends, that is, immediately after the melt M in the cup portion 5*a* fully flows into the tubular portion 5*b*, the gas-blowing nozzle 1*a* is moved downward by the gas-ejecting-member-moving mechanism 11 to be fit into the tubular portion 5*b*, as shown in FIG. 10(*c*).

Because the gas-blowing nozzle 1*a* is placed at such a position that its tip end (gas-ejecting port) comes into contact with the melt M in the cup portion 5*a*, until gravity-pouring ends, the gas-blowing nozzle 1*a* is close to the tubular portion 5*b*, thereby saving a time taken to connect the gas-blowing nozzle 1*a* to the tubular portion 5*b*. Furthermore, when the gas-blowing nozzle 1*a* is controlled to follow the lowering surface of the melt, the gas-blowing nozzle 1*a* can be more quickly connected to the tubular portion 5*b*.

(5) Embodiment 5

Embodiment 5 is the same as Embodiment 1, except that the stream of the pouring melt M is cast to a position away from the tubular portion 5*b* within the cup portion 5*a*, and that the gas-blowing nozzle 1*a* is placed such that its tip end (gas-ejecting port) is below the upper edge of the cup portion 5*a*, or in contact with the melt M in the cup portion 5*a*, during the pouring step.

As shown in FIG. 11(*a*), the casting apparatus in Embodiment 5 is the same as in Embodiment 1 shown in FIG. 7(*a*), except for comprising a pouring-means-moving unit 12 for moving the ladle (pouring means) 2 or adjusting a position of the stream of the melt M. The pouring-means-moving unit 12 can move the ladle 2 away from the operation range 10, so that the stream of the melt M is cast to a position away from the tubular portion 5*b*.

During the pouring step, as shown in FIG. 11(*a*), the ladle 2 is placed such that the stream 2*a* of the melt M is cast to or near the tubular portion 5*b*, like in Embodiment 1. Therefore, with splashing from the cup portion 5*a* suppressed, the melt M can efficiently flow into the tubular portion 5*b* in a short period of time.

As shown in FIG. 11(*b*), until the ladle 2 stops pouring the melt M, the ladle 2 is moved by the pouring-means-moving unit 12 such that the stream 2*a* of the melt M is cast to a position away from the tubular portion 5*b*, and the gas-blowing nozzle 1*a* is then moved to such a position that its tip end (gas-ejecting port) is below the upper edge of the cup portion 5*a*.

As shown in FIG. 11(*c*), immediately after pouring the melt M from the ladle 2 ends, and while the melt M resides in the cup portion 5*a* without completely flowing into the tubular portion 5*b*, the tip end (gas-ejecting port) of the gas-blowing nozzle 1*a* is brought into contact with the melt M in the cup portion 5*a*. The gas-blowing nozzle 1*a* may be controlled to follow a lowering surface of the melt M remaining in the cup portion 5*a*, which flows into the tubular portion 5*b*.

Immediately after gravity-pouring ends, that is, immediately after the melt M in the cup portion 5*a* fully flows into the tubular portion 5*b*, the gas-blowing nozzle 1*a* is moved downward by the gas-ejecting-member-moving mechanism 11 to be fit into the tubular portion 5*b*, as shown in FIG. 11(*d*).

Because the stream 2*a* of the melt M is cast to a position away from the tubular portion 5*b* until the ladle 2 stops pouring the melt M, the tip end of the gas-blowing nozzle 1*a* can be placed below the upper edge of the cup portion 5*a* even during the pouring step. Therefore, the gas-blowing nozzle 1*a* can be quickly brought into contact with the melt M in the cup portion 5*a* immediately after the ladle 2 stops pouring the melt M, thereby saving a time taken to connect the blowing nozzle 1*a* to the tubular portion 5*b*, as explained in Embodiments 3 and 4.

(6) Embodiment 6

Embodiment 6 is the same as Embodiment 5 except for changing a shape of the cup portion 5*a*. As shown in FIGS. 12(*a*)-12(*d*), the cup portion 5*e* extends in one direction from the tubular portion 5*b*.

The casting apparatus in Embodiment 6 is the same as in Embodiment 1, except for comprising a pouring-means-moving unit 12 capable of moving the ladle 2, or adjusting a position of the stream of the melt M, like in Embodiment 5.

During the pouring step, as shown in FIG. 12(*a*), the ladle 2 is placed such that the stream 2*a* of the melt M is cast to or near the tubular portion 5*b*, like in Embodiment 5.

Until the ladle 2 stops pouring the melt M, as shown in FIG. 12(*b*), the ladle 2 is moved by the pouring-means-moving unit 12, such that the stream 2*a* of the melt M is cast to a position away from the tubular portion 5*b*, and the gas-blowing nozzle 1*a* is moved to such a position that its tip end (gas-ejecting port) is below the upper edge of the cup portion 5*e*.

Because the cup portion 5*e* extends in a direction A (shown by an arrow) from the tubular portion 5*b* as shown in FIGS. 4(*a*) and 4(*b*), the melt stream can be cast in a region of the cup portion 5*e* even when the ladle 2 is moved away in the direction A, thereby suppressing melt splashing from the sprue. In addition, the bottom surface of the cup portion 5*e* is inclined deeper as nearing the tubular portion 5*b*, such that the poured melt M efficiently flows into the tubular portion 5*b*. The cup portion 5*e* having such a shape can be easily formed by moving the sprue cutter for forming a cup-like recess 14*a* in the direction A with the above inclination.

Immediately after pouring the melt M from the ladle 2 ends and while the melt M resides in the cup portion 5*e* without completely flowing into the tubular portion 5*b*, as shown in FIG. 12(*c*), the tip end (gas-ejecting port) of the gas-blowing nozzle 1*a* is brought into contact with the melt M in the cup portion 5*e*. The gas-blowing nozzle 1*a* may be controlled to follow a lowering surface of the melt M in the cup portion 5*e*, which flows into the tubular portion 5*b*.

Immediately after gravity-pouring ends, that is, immediately after the melt M in the cup portion 5*e* fully flows into the tubular portion 5*b*, the gas-blowing nozzle 1*a* is moved downward by the gas-ejecting-member-moving mechanism 11 to be fit into the tubular portion 5*b*, as shown in FIG. 12(*d*).

(7) Embodiment 7

Figure 13:
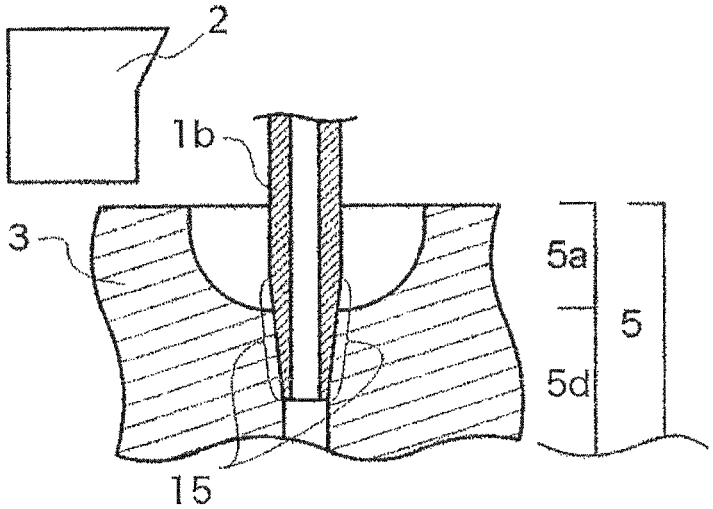
FIG. 13 is a schematic cross-sectional view showing connection of a gas-blowing nozzle of the casting apparatus in Embodiment 7 to a sprue.

Embodiment 7 is the same as Embodiment 1 except for changing a portion of a gas-blowing nozzle 1*a* connected to a sprue 5. In Embodiment 7, as shown in FIG. 13, a tip end portion of a gas-blowing nozzle 1*b* has a tapered side surface 15 to be fit into a complementarily tapered tubular portion 5*d*. These structures facilitate positioning of the gas-blowing nozzle into the tubular portion, thereby saving a time from the end of the gravity-pouring step to the beginning of blowing a gas.

Effects of the Invention

According to the present invention, the gas-blowing unit can be quickly connected to the sprue to blow a gas into the cavity of the gas-permeable casting mold after pouring ends, thereby suppressing defects such as cold shut and pull down due to stagnation of melt supply.

What is claimed is:

1. A method for producing a casting comprises the steps of:

pouring a metal melt by gravity into a gas-permeable casting mold comprising a cavity including a sprue composed of a tubular portion and a cup portion having a larger diameter than that of the tubular portion to receive the metal melt, a runner constituting a flow path of the metal melt supplied through the sprue, and a product-forming cavity to be filled with the metal melt sent through the runner; and then blowing a gas into the cavity of the gas-permeable casting mold from a gas-ejecting member of a gas-blowing unit, to fill the product-forming cavity with the metal melt;

wherein the gas-ejecting member is placed at a position just above the tubular portion and not interfering with gravity pouring of the metal melt, and moved downward to the sprue for connection to the tubular portion after gravity-pouring ends;

the method further comprising the steps of placing a stream of the metal melt poured from a pouring means just above or near the tubular portion at an early stage of a pouring step, and moving the stream away therefrom within a region of the cup portion at a late stage of the pouring step.

2. The method for producing a casting according to claim 1, wherein the gas-ejecting member is placed such that a gas-ejecting port of the gas-ejecting member is below an upper edge of the cup portion.

3. The method for producing a casting according to claim 1, wherein the gas-ejecting member is placed such that a gas-ejecting port of the gas-ejecting member comes into contact with the metal melt residing in the cup portion.

4. The method for producing a casting according to claim 1, wherein the pouring means is placed at a position away from the position just above or near the tubular portion at least at the end of pouring of the melt so that the pouring means is located at a position away from an operation range of the gas-ejecting member.

5. The method for producing a casting according to claim 1, further comprising the step of controlling the position of the gas-ejecting member of the gas-blowing unit according to a surface position of the metal melt residing in the sprue.

* * * * *